US011312927B2

(12) United States Patent
Cuilleret

(10) Patent No.: US 11,312,927 B2
(45) Date of Patent: Apr. 26, 2022

(54) FOAMING HARD SURFACE CLEANING COMPOSITION WITH A PH COLOR CHANGE

(71) Applicant: Dow Global Technologies LLC, Midland, MI (US)

(72) Inventor: Muriel Cuilleret, Grasse (FR)

(73) Assignee: Dow Global Technologies LLC, Midland, MI (US)

( * ) Notice: Subject to any disclaimer, the term of this patent is extended or adjusted under 35 U.S.C. 154(b) by 132 days.

(21) Appl. No.: 16/604,590

(22) PCT Filed: May 18, 2018

(86) PCT No.: PCT/US2018/033307
§ 371 (c)(1),
(2) Date: Oct. 11, 2019

(87) PCT Pub. No.: WO2018/222410
PCT Pub. Date: Dec. 6, 2018

(65) Prior Publication Data

US 2021/0115360 A1 Apr. 22, 2021

(30) Foreign Application Priority Data

May 29, 2017 (EP) ..... 17290072

(51) Int. Cl.

| | |
|---|---|
| ***C11D 1/22*** | (2006.01) |
| ***C11D 3/37*** | (2006.01) |
| ***C11D 1/72*** | (2006.01) |
| ***C11D 3/00*** | (2006.01) |
| ***C11D 3/34*** | (2006.01) |
| ***C11D 11/00*** | (2006.01) |
| ***C11D 17/00*** | (2006.01) |

(52) U.S. Cl.
CPC ..... *C11D 3/3765* (2013.01); *C11D 1/72* (2013.01); *C11D 3/0026* (2013.01); *C11D 3/0047* (2013.01); *C11D 3/0052* (2013.01); *C11D 3/3418* (2013.01); *C11D 11/0029* (2013.01); *C11D 11/0052* (2013.01); *C11D 17/0013* (2013.01)

(58) Field of Classification Search
CPC ..... C11D 1/22; C11D 3/0094; C11D 3/201; C11D 3/43; C11D 7/5004; C11D 11/0023; C11D 17/08; C11D 3/3746; C11D 3/042
See application file for complete search history.

(56) References Cited

U.S. PATENT DOCUMENTS

| | | | | |
|---|---|---|---|---|
| 5,597,793 | A | 1/1997 | Besse et al. | |
| 5,783,110 | A | 7/1998 | Verdicchio et al. | |
| 2006/0134239 | A1* | 6/2006 | Weide | A61P 3/00 424/745 |
| 2011/0132387 | A1* | 6/2011 | Alwattari | A61Q 19/10 132/200 |
| 2014/0290695 | A1* | 10/2014 | Uchiyama | C11D 3/2068 134/6 |
| 2017/0175041 | A1* | 6/2017 | Ahirwal | C11D 17/0026 |

FOREIGN PATENT DOCUMENTS

| | | | |
|---|---|---|---|
| WO | 0176552 | A2 | 10/2001 |
| WO | 2014161714 | A1 | 10/2014 |

* cited by examiner

*Primary Examiner* — Charles I Boyer
(74) *Attorney, Agent, or Firm* — Thomas S. Deibert

(57) ABSTRACT

A hard surface cleaning composition is provided, including: carbon dioxide; an ionic acrylic based rheology modifier comprising at least one of an alkali swellable emulsion polymer and a hydrophobically-modified alkali swellable emulsion polymer; a pH adjuster; a surfactant; at least one of an alkyl benzene sulfonic acid and an alkyl benzene sulfonate; water; a cosolvent; and, optionally, a pH color indicator; wherein the pH of the hard surface cleaning composition is 3.5 to 6.0. Also provided is a method of cleaning a hard surface.

12 Claims, No Drawings

FOAMING HARD SURFACE CLEANING COMPOSITION WITH A PH COLOR CHANGE

The present invention relates to a hard surface cleaning composition. In particular, the present invention relates to a hard surface cleaning composition containing an ionic acrylic based rheology modifier and a carbon dioxide dissolved in the composition and methods of using the same to clean hard surfaces.

Surface cleaning is a practice taken to maintain hygiene, aesthetics, serviceability and mechanical integrity. In any given setting, hard surfaces such as walls, countertops, ranges, grills, ovens may all present challenging surfaces to clean, disinfect and maintain. Vertical surfaces tend to provide a particular challenge. Such surfaces, from time to time, retain residual contamination that is difficult to remove. Further, given the useful life of these surfaces, this challenge tends to be ongoing.

A variety of conventional hard surface cleaning formulations have been disclosed, for example, adherent foam cleaning compositions for hard surface cleaning are disclosed by Besse in U.S. Pat. No. 5,597,793. Besse disclose a method of preparing an adherent foam cleaning composition comprising adding a foam stabilizing composition, said foam stabilizing composition comprising an amount of an alkalinity source sufficient to attain a pH between about 4.5 and 5.5 in said foam stabilizing composition, from about 1.0 wt % to 95 wt % of a vinyl acrylic polymer emulsion, from about 0.1 wt % to 0.3 wt % of an antimicrobial agent and a balance of water, to an alkaline cleaning composition to provide said adherent foam cleaning composition having a viscosity of less than 300 centipoise.

Notwithstanding, there remains a continuing need for effective hard surface cleaning compositions. In particular, there remains a need for an effective hard surface cleaning composition that provides cleaning action across a wide pH window to facilitate the attack and removal of a range of difficult to clean hard surface contaminant residues.

The present invention provides a hard surface cleaning composition, comprising: carbon dioxide; an ionic acrylic based rheology modifier comprising at least one of an alkali swellable emulsion polymer and a hydrophobically-modified alkali swellable emulsion polymer; a pH adjuster; a surfactant; at least one of an alkyl benzene sulfonic acid and an alkyl benzene sulfonate; water; a cosolvent; and, optionally, a pH color indicator; wherein the pH of the hard surface cleaning composition is 3.5 to 6.0.

The present invention provides a hard surface cleaning composition, comprising: carbon dioxide; an ionic acrylic based rheology modifier comprising at least one of an alkali swellable emulsion polymer and a hydrophobically-modified alkali swellable emulsion polymer; a pH adjuster; a surfactant; at least one of an alkyl benzene sulfonic acid and an alkyl benzene sulfonate; water; a cosolvent; and, optionally, a pH color indicator; wherein the ionic acrylic based rheology modifier comprises a compound of Formula (I):

(I)

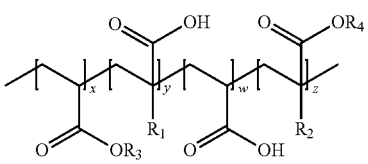

wherein $R_1$ and $R_2$ are each independently selected from a H and a $C_1$-$C_6$ alkyl group; wherein $R_3$ and $R_4$ are each independently selected from a H and a $C_1$-$C_{24}$ alkyl or alkoxylated alkyl group; and wherein the pH of the hard surface cleaning composition is 3.5 to 6.0.

The present invention provides a method of cleaning a hard surface, comprising: applying a hard surface cleaning composition according to claim 1 onto the hard surface forming a foam; letting the foam remain on the hard surface; wherein the carbon dioxide evolves from the foam resulting in a change in the pH of the foam over time; wherein the change in the pH triggers a transition of the foam from an initial color upon application to the hard surface to a transitioned color; wherein the initial color and the transitioned color are different; and wherein the transitioned color provides a visual cue that cleaning is occurring.

DETAILED DESCRIPTION

Disclosed is a hard surface cleaning composition containing carbon dioxide and an ionic acrylic based rheology modifier for cleaning hard surfaces, such as, toilet bowls, sinks, showers, kitchen and bathroom tiles, glass countertops and splash surfaces; particularly vertical surfaces; wherein the viscosity of the hard surface cleaning composition increased after deposition to form a foam on application to the surface; wherein the foam adheres to the surface (preferably, without sagging) for an extended period of time (preferably, up to three hours). While not wishing to be bound by theory, it is believed that the introduction of carbon dioxide in the hard surface cleaning compositions of the present invention including acrylic based ionic rheology modifiers creates a modification of the pH that impacts the rheological behavior of the formulation. For example, a gel-like formulation can change to a liquid-like formulation upon lowering of the pH by introduction of the carbon dioxide in an enclosed container. Once the composition is dispensed from the enclosed container onto a hard surface, the dissolved carbon dioxide evolves from the composition, thereby raising the pH of the composition and changing the formulation from a liquid-like low viscosity formulation back to a gel-like high viscosity formulation.

Unless otherwise indicated, ratios, percentages, parts, and the like are by weight.

The term "polymer" as used herein and in the appended claims refers to a compound prepared by polymerizing monomers, whether of the same or a different type. The generic term "polymer" includes the terms "homopolymer", "copolymer", and "terpolymer".

The term "polymerized units derived from" as used herein and in the appended claims refers to polymer molecules that are synthesized according to polymerization techniques wherein a product polymer contains "polymerized units derived from" the constituent monomers which are the starting materials for the polymerization reactions. As used herein, the term "(meth)acrylate" refers to either acrylate or methacrylate, and the term "(meth)acrylic" refers to either acrylic or methacrylic. As used herein, the term "substituted" refers to having at least one attached chemical group, for example, alkyl group, alkenyl group, vinyl group, hydroxyl group, carboxylic acid group, other functional groups, and combinations thereof.

The term "substituted" as used herein and in the appended claims means that the compound or group is substituted with at least one (e.g., 1, 2, 3, or 4) substituents independently selected from a hydroxyl, a $C_{1-9}$ alkoxy, a $C_{1-9}$ haloalkoxy, an oxo, a nitro, a cyano, an amino, an azido, an amidino, a hydrazino, a hydrazono, a carbonyl, a carbamoyl, a sulfonyl, a thiol, a thiocyano, a tosyl, a carboxylic acid, a carboxylic $C_{1-6}$ alkyl ester, a $C_{1-12}$ alkyl, a $C_{3-12}$ cycloalkyl, a $C_{2-12}$ alkenyl, a $C_{5-12}$ cycloalkenyl, a $C_{2-12}$ alkynyl, a $C_{6-12}$ aryl, or a $C_{7-13}$ arylalkylene in place of a hydrogen, provided that the substituted atom's normal valence is not exceeded.

The term "aliphatic" as used herein and in the appended claims means a saturated or unsaturated linear or branched hydrocarbon. An aliphatic group may be an alkyl, alkenyl, or alkynyl group, for example.

The term "alkyl" as used herein and in the appended claims means a straight or branched chain, saturated, monovalent hydrocarbon group (e.g., methyl or hexyl).

The term "alkylene" as used herein and in the appended claims means a straight or branched chain, saturated, divalent aliphatic hydrocarbon group, (e.g., methylene (—$CH_2$—) or, propylene (—$(CH_2)_3$—)).

The term "aryl" as used herein and in the appended claims means a monovalent group formed by the removal of one hydrogen atom from one or more rings of an arene (e.g., phenyl or napthyl).

The term "hard surface" as used herein and in the appended claims means any porous or nonporous inanimate surfaces. Preferred hard surfaces are selected from the group consisting of ceramic (e.g., toilet bowls, sinks, showers, kitchen and bathroom tile), glass (e.g., windows), metal (e.g., drain pipe, faucets, fixtures), polymer (e.g., PVC piping, fiberglass, Corian), stone (e.g., granite, marble) and combinations thereof; wherein the hard surface is not a silicon wafer or a semiconductor substrate.

Preferably, the hard surface cleaning composition of the present invention, comprises: (preferably, 0.5 to 10 wt %; more preferably, 1.0 to 5.0 wt %; most preferably, 1.5 to 3 wt % of) carbon dioxide; (preferably, 0.1 to 30 wt %; more preferably, 1 to 15 wt %; most preferably, 3 to 9 wt % of) an ionic acrylic based rheology modifier comprising at least one of an alkali swellable emulsion polymer and a hydrophobically-modified alkali swellable emulsion polymer; (preferably, 0.01 to 10 wt %; more preferably, 0.1 to 5 wt %; most preferably, 0.5 to 2 wt % of) a pH adjuster; (preferably, 0.01 to 30 wt %; more preferably, 0.1 to 15 wt %; most preferably, 0.5 to 5 wt % of) a surfactant (preferably, a nonionic surfactant); (preferably, 0.01 to 5 wt %; more preferably, 0.1 to 3 wt %; most preferably, 0.5 to 1.5 wt % of) at least one of an alkyl benzene sulfonic acid and an alkyl benzene sulfonate; water; (preferably, 0.01 to 10 wt %; more preferably, 0.1 to 5 wt %; most preferably, 0.5 to 2 wt % of) a cosolvent; and, optionally, a pH color indicator; wherein the pH of the hard surface cleaning composition is 3.5 to 6.0 (preferably, 4.0 to 6.0; more preferably, 4.5 to 6.0; most preferably, 5 to 5.5).

The hard surface cleaning composition of the present invention, comprises: carbon dioxide. Preferably, the carbon dioxide is dissolved in the hard surface cleaning composition. Preferably, the hard surface cleaning composition of the present invention comprises: 0.5 to 10 wt % carbon dioxide (preferably, wherein the carbon dioxide is dissolved in the hard surface cleaning composition). More preferably, the hard surface cleaning composition of the present invention comprises: 1.0 to 5.0 wt % carbon dioxide (preferably, wherein the carbon dioxide is dissolved in the hard surface cleaning composition). Still more preferably, the hard surface cleaning composition of the present invention comprises: 1.5 to 3 wt % carbon dioxide (preferably, wherein the carbon dioxide is dissolved in the hard surface cleaning composition). Most preferably, the hard surface cleaning composition of the present invention comprises: 1.5 to 3 wt % carbon dioxide, wherein the carbon dioxide is dissolved in the hard surface cleaning composition.

The hard surface cleaning composition of the present invention, comprises: an ionic acrylic based rheology modifier comprising at least one of an alkali swellable emulsion polymer and a hydrophobically-modified alkali swellable emulsion polymer. Preferably, the hard surface cleaning composition of the present invention comprises: 0.1 to 30 wt % of an ionic acrylic based rheology modifier comprising at least one of an alkali swellable emulsion polymer and a hydrophobically-modified alkali swellable emulsion polymer. More preferably, the hard surface cleaning composition of the present invention comprises: 1 to 15 wt % of an ionic acrylic based rheology modifier comprising at least one of an alkali swellable emulsion polymer and a hydrophobically-modified alkali swellable emulsion polymer. Most preferably, the hard surface cleaning composition of the present invention comprises: 3 to 9 wt % of an ionic acrylic based rheology modifier comprising at least one of an alkali swellable emulsion polymer and a hydrophobically-modified alkali swellable emulsion polymer.

Preferred ionic acrylic based rheology modifiers include synthetic polymers with amine groups, acid groups, or both. For example, synthetic polymers include polymers made with monomer mixtures that include one or more amine-containing (meth)acrylate monomers (e.g. (meth)acrylamide) and, optionally other monomers, including, for example, one or more non-amine-containing (meth)acrylate monomers. Synthetic polymers suitable as ionic rheology modifiers also include, for example, polymers made from monomer mixtures that include one or more acid-containing (meth)acrylate monomers (such as, for example, (meth) acrylic acid) and, optionally other monomers, including, for example, one or more non-acid-containing (meth)acrylate monomers (which may be monoethylenically unsaturated or multiethylenically unsaturated or a mixture thereof).

Preferred ionic acrylic based rheology modifier include hydrophobically-modified synthetic polymers made from monomer mixtures that include at least one polymerized unit derived from an amine-containing monomer or at least one acid-containing monomer. Preferably, the hydrophobic group is attached, for example, by including, in the monomer mixture from which the hydrophobically modified synthetic polymer is made, one or more monomers with hydrophobic groups (i.e., a hydrocarbons with 6 or more carbon atoms, fluoro-substituted hydrocarbons with 3 or more carbon atoms and at least one fluorine atom, organosiloxane-containing organic radicals, or combinations thereof); such polymers include, for example, copolymers made from monomer mixtures that include (meth)acrylic acid, $C_{10}$-$C_{20}$ alkyl (meth)acrylates, optionally multiethylenically unsaturated (meth)acrylates, and other (meth)acrylates.

Preferably, the hard surface cleaning composition of the present invention includes an ionic acrylic based rheology modifier, wherein the ionic acrylic based rheology modifier includes at least one of an alkali swellable emulsion ("ASE") polymer and a hydrophobically-modified alkali swellable emulsion ("HASE") polymer. ASE and HASE polymers are typically synthesized by free-radical emulsion polymerization of varying mixtures of hydrophilic monomers (e.g., acrylic acid, methacrylic acid, maleic anhydride); lipophilic monomers (e.g., ethyl acrylate, butyl acrylate, methyl methacrylate) and associative monomers (e.g., long chain $C_5$-$C_{22}$ acrylate or styrene derivative monomers). Preferred ionic acrylic based rheology modifiers are ASE and HASE polymers incorporating the structure of Formula (I):

(I)

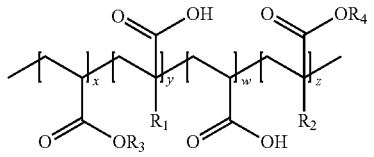

wherein $R_1$ and $R_2$ are each independently selected from a H and a $C_1$-$C_6$ alkyl group (preferably, a $C_{1-2}$ alkyl group; most preferably, a $C_1$ alkyl group); wherein $R_3$ and $R_4$ are each independently selected from a H and a $C_1$-$C_{24}$ alkyl or alkoxylated alkyl group (preferably, a $C_{8-20}$ alkyl group) (preferably, wherein the alkoxylated alkyl group is ethoxylated or propoxylated)(preferably, wherein the alkoxylated alkyl group is alkoxylated to an average degree of 1 to 60 (preferably, 10 to 50; most preferably, 15 to 30) per molecule. Preferred ionic acrylic based rheology modifiers are ASE and HASE polymers according to Formula (I) have a weight ratio of x:y of 1:20 to 20:1 (preferably, 1:10 to 10:1; more preferably, 1:5 to 5:1). Preferred ionic acrylic based rheology modifiers are ASE and HASE polymers according to Formula (I) have a weight ratio of x:w of 1:20 to 20:1 (preferably, 1:10 to 10:1; more preferably, 1:5 to 5:1). Preferred ionic acrylic based rheology modifiers are ASE and HASE polymers according to Formula (I) have a weight ratio of x:z of 1:1 to 500:1 (preferably, 2:1 to 250:1; more preferably, 25:1 to 75:1). Preferred ionic acrylic based rheology modifiers are ASE and HASE polymers according to Formula (I), wherein x+y+w+x≥90 wt % (preferably, ≥95 wt %) of the ionic acrylic based rheology modifier; wherein the ionic acrylic based rheology modifier of Formula (I) further comprises 0 to 10 wt % (more preferably, 0 to 5 wt %) of other vinyl monomers. The ionic acrylic based rheology modifiers of Formula (I) optionally contain polymerized units derived from other vinyl monomers selected from the group consisting of vinyl acetals, vinyl acetates, vinyl alcohols, vinyl halides, vinyl ethers, crosslinking agents and chain transfer agents (preferably, wherein the other vinyl monomers are selected from the group consisting of vinyl acetates, crosslinking agents and chain transfer agents; most preferably, wherein the other vinyl monomers include vinyl acetates and crosslinking agents). The ionic acrylic based rheology modifier of Formula (I) optionally contain polymerized units derived from a crosslinking agent. Preferred crosslinking agents include multiethylenically unsaturated monomers such as allyl methacrylate (ALMA); divinylbenzene (DVB); ethyleneglycol diacrylate (EGDA); ethyleneglycol dimethacrylate (EGDMA); 1,3-butanediol dimethacrylate (BGDMA); diethyleneglycol dimethacrylate (DEGDMA); tripropyleneglycol diacrylate (TRPGDA); trimethylolpropane trimethacrylate (TMPTMA); trimethylolpropane triacrylate (TMPTA) and trimethylolpropane diallyl ether (TMPDE). Preferred ionic acrylic based rheology modifiers of Formula (I) have a crosslinker content 0 to 3 wt % (preferably, 0.01 to 3 wt %; more preferably, 0.05 to 1.5 wt %; most preferably, 0.1 to 1 wt %).

Polymer molecular weights of the ionic acrylic based rheology modifiers are measured by standard methods such as, for example, size exclusion chromatography or intrinsic viscosity. Preferably, the ionic acrylic based rheology modifiers of Formula (I) have a weight average molecular weight (Mw) of from 50,000 to 1,000,000 g/mol, preferably of from 80,000 to 500,000 g/mol, and more preferably of from 100,000 to 300,000 g/mol, as measured by gel permeation chromatography.

Preferably, hard surface cleaning composition of the present invention, comprises: a pH adjuster; wherein the pH adjuster is selected from at least one of sodium hydroxide, potassium hydroxide, sodium carbonate, potassium carbonate, monoethanolamine, triethanolamine, aminomethylpropanol, aminomethylpropanediol and trimethamine More preferably, the hard surface cleaning composition of the present invention, comprises: a pH adjuster; wherein the pH adjuster includes at least one of sodium hydroxide and potassium hydroxide. Most preferably, the hard surface cleaning composition of the present invention, comprises: a pH adjuster; wherein the pH adjuster includes sodium hydroxide.

Preferably, the hard surface cleaning composition of the present invention, comprises a pH adjuster in sufficient quantity such that the pH of the hard surface cleaning composition is 3.5 to 6.0 (preferably, 4.0 to 6.0; more preferably, 4.5 to 6.0; most preferably, 5 to 5.5). Preferably, the hard surface cleaning composition of the present invention, comprises: 0.01 to 10 wt % of a pH adjuster, wherein the pH of the hard surface cleaning composition is 3.5 to 6.0 (preferably, 4.0 to 6.0; more preferably, 4.5 to 6.0; most preferably, 5 to 5.5). More preferably, the hard surface cleaning composition of the present invention, comprises: 0.1 to 5 wt % of a pH adjuster; wherein the pH of the hard surface cleaning composition is 3.5 to 6.0 (preferably, 4.0 to 6.0; more preferably, 4.5 to 6.0; most preferably, 5 to 5.5). Most preferably, the hard surface cleaning composition of the present invention, comprises: 0.5 to 2 wt % of a pH adjuster; wherein the pH of the hard surface cleaning composition is 3.5 to 6.0 (preferably, 4.0 to 6.0; more preferably, 4.5 to 6.0; most preferably, 5 to 5.5).

The hard surface cleaning composition of the present invention, comprises a surfactant. Preferably, the hard surface cleaning composition of the present invention, comprises 0.01 to 30 wt % of a surfactant. More preferably, the hard surface cleaning composition of the present invention, comprises 0.1 to 15 wt % of a surfactant. Post preferably, the hard surface cleaning composition of the present invention, comprises 0.5 to 5 wt % of a surfactant. Preferably, the surfactant is selected from the group consisting of a nonionic surfactant, a cationic surfactant, a zwitterionic surfactant and mixtures thereof. Most preferably, the surfactant is a nonionic surfactant.

Nonionic surfactants include, for example, a $C_{2-4}$ alkylene oxide condensate of a mono- or poly-hydroxy substituted or unsubstituted $C_{6-22}$ aliphatic alcohol, a substituted or unsubstituted $C_{6-12}$ alkyl phenol, a fatty acid amide or a fatty amine; an alkyl saccharide; an amine oxide; a sugar derivative (e.g., a sucrose monopalmitate); a glucamine; a long chain tertiary phosphine oxide; a dialkyl sulfoxide; a fatty acid amide (e.g., a mono- or di-ethanol amide of a $C_{10-18}$ fatty acid) and mixtures thereof.

Preferably, the nonionic surfactant is selected from a $C_{2-4}$ alkylene oxide condensate of a mono- or poly-hydroxy substituted or unsubstituted $C_{6-22}$ aliphatic alcohol. More preferably, the nonionic surfactant is an alkylene oxide condensation product of an aliphatic or aromatic alcohol, wherein the nonionic surfactant comprises an average of 1 to 75 moles (preferably, 1 to 50 moles; more preferably, 1 to 15 moles; most preferably, 2 to 9 moles) of a $C_{2-4}$ alkylene oxide per mole of a substituted or unsubstituted $C_{6-22}$ aliphatic alcohol (preferably, an unsubstituted $C_{6-22}$ aliphatic alcohol). Still more preferably, the $C_{2-4}$ alkylene oxide is selected from at least one of ethylene oxide and propylene oxide. Preferably, the nonionic surfactant is selected from an ethoxylated and/or propoxylated unsubstituted $C_{6-22}$ aliphatic alcohol; and an ethoxylated and/or propoxylated unsubstituted $C_{6-12}$ alkyl phenol. More preferably, the nonionic surfactant is selected from an ethoxylated and/or propoxylated unsubstituted $C_{8-20}$ aliphatic alcohol. Most preferably, the nonionic surfactant is selected from an ethoxylated and/or propoxylated unsubstituted $C_{8-20}$ aliphatic alcohol, with an average of 2 to 9 moles of ethylene oxide and/or propylene oxide per molecule. Preferably, the nonionic surfactant is a condensation product of a $C_{26-12}$ alkyl hydroxide and an average of 2 to 9 moles (total) of ethylene oxide and propylene oxide per mole of alcohol. The surfactant preferably has a hydrophilic-lipophilic balance of 8 to 14 (more preferably, 8.5 to 13.5; most preferably, 9 to 13). A preferred nonionic surfactant is a 2-ethyl hexanol ethylene oxide-propylene oxide.

Preferably, the alkyl saccharide is selected from alkyl saccharides comprising a $C_{6-18}$ alkyl group (preferably, a $C_{8-16}$ alkyl group) and a saccharide or polysaccharide group (e.g., a glucoside or polyglucoside hydrophilic group). Preferably, the alkyl saccharide comprises an average of 1 to 10 (preferably, 1.2 to 5; more preferably, 1.3 to 3) saccharide units per molecule. Preferred alkyl glucosides comprise an alkyleneoxide group joining the hydrophobic moiety and the polysaccharide moiety. A preferred alkyleneoxide is ethylene oxide. The $C_{6-18}$ alkyl group of the alkyl saccharide may be saturated or unsaturated, and branched or unbranched. Preferably, the $C_{6-18}$ alkyl group contains up to an average of 3 hydroxy groups and/or the alkylene oxide group contains an average of 1 to 10 (preferably, 2 to 5) alkylene oxide moieties. Preferred alkyl polysaccharides include octyl, nonyldecyl, undecyldodecyl, tridecyl, tetradecyl, pentadecyl, hexadecyl, heptadecyl and octadecyl, di-, tri-, terra-, penta-, and hexaglucosides, galactosides, lactosides, glucoses, fructosides, fructoses and/or galactoses. Preferred combinations include coconut alkyl, di-, tri-, terra-, and pentaglucosides and tallow alkyl terra-, penta-, and hexaglucosides. Preferably, the alkyl polysaccharides include polyglucosides comprise a $C_{8-16}$ alkyl group (preferably, a $C_{-8-10}$ alkyl group).

Preferred amine oxides include dimethyl-dodecylamine oxide, oleyldi(2-hydroxyethyl) amine oxide, dimethyltetradecylamine oxide, di(2-hydroxyethyl)-tetradecylamine oxide, dimethylhexadecylamine oxide, behenamine oxide, cocamine oxide, decyltetradecylamine oxide, dihydroxyethyl $C_{12-15}$ alkoxypropylamine oxide, dihydroxyethyl cocamine oxide, dihydroxyethyl lauramine oxide, dihydroxyethyl stearamine oxide, dihydroxyethyl tallowamine oxide, hydrogenated palm kernel amine oxide, hydrogenated tallowamine oxide, hydroxyethyl hydroxypropyl $C_{12-15}$ alkoxypropylamine oxide, lauramine oxide, myristamine oxide, myristyl/cetyl amine oxide, oleamidopropylamine oxide, oleamine oxide, palmitamine oxide, PEG-3 lauramine oxide, dimethyl lauramine oxide, potassium trisphosphonomethylamine oxide, stearamine oxide, and tallowamine oxide. In an embodiment, the amine oxide is lauramine oxide.

Preferred cationic surfactants include $C_{16-18}$ dialkyldimethylammonium chloride and $C_{8-18}$ alkyl dimethyl benzyl ammonium chloride.

Preferred zwitterionic surfactants include aliphatic quaternary ammonium compounds, such as, 3-(N,N-dimethyl-N-hexadecyl-ammonio)propane-1-sulfonate and 3-(N,N-dimethyl-N-hexadecylammonio)-2-hydroxypropane-1-sulfonate.

The hard surface cleaning composition of the present invention, comprises at least one of an alkyl benzene sulfonic acid and an alkyl benzene sulfonate. Preferably, the hard surface cleaning composition of the present invention, comprises 0.01 to 30 wt % of at least one of an alkyl benzene sulfonic acid and an alkyl benzene sulfonate. More preferably, the hard surface cleaning composition of the present invention, comprises 0.1 to 15 wt % of at least one of an alkyl benzene sulfonic acid and an alkyl benzene sulfonate. Most preferably, the hard surface cleaning composition of the present invention, comprises 0.5 to 5 wt % of at least one of an alkyl benzene sulfonic acid and an alkyl benzene sulfonate.

Preferably, the at least one of an alkyl benzene sulfonic acid and an alkyl benzene sulfonate is a $C_{8-20}$ alkyl benzene sulfonate. Preferably, the $C_{8-20}$ alkylbenzenesulfonate is selected from a linear $C_{8-12}$ alkyl benzene sulfonate (e.g., sodium dodecyl benzene sulfonate), a $C_{6-18}$ alkyl diphenyloxide disulfonate, a $C_{12-16}$ alcohol sulfate, an ethoxylated $C_{12-16}$ alcohol sulfate, a hydroxy alkyl sulfonate, a $C_{12-16}$ alkenyl sulfate or sulfonate, a $C_{12-16}$ alkyl sulfate or sulfonate, a monoglyceride sulfate, a $C_{12-16}$ alkyl sulfosuccinate, or an acid condensate of a fatty acid chloride with hydroxy alkyl sulfonate. More preferably, the at least one of an alkyl benzene sulfonic acid and an alkyl benzene sulfonate is an alkyl diphenyl oxide disulfonate compound of the formula

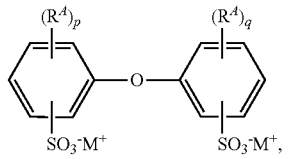

wherein $R^A$ at each occurrence is independently a $C_{6-18}$ alkyl group; $M^+$ is $H^+$ or a monovalent cation; and p and q are independently 0 or 1, provided that, at least one of p and q is 1 (preferably, p is 0 and $R^A$ is a $C_{12}$ alkyl group or a $C_{16}$ alkyl group).

The hard surface cleaning composition of the present invention, comprises water. Preferably, the hard surface cleaning composition of the present invention comprises 10 to 99 wt % water. More preferably, the hard surface cleaning composition of the present invention comprises 25 to 98 wt % water. Most preferably, the hard surface cleaning composition of the present invention comprises 50 to 97 wt % water.

The hard surface cleaning composition of the present invention, comprises a cosolvent. Preferably, the hard surface cleaning composition of the present invention, comprises 0.01 to 10 wt % of a cosolvent. More preferably, the hard surface cleaning composition of the present invention, comprises 0.1 to 5 wt % of a cosolvent. Most preferably, the hard surface cleaning composition of the present invention, comprises 0.5 to 2 wt % of a cosolvent.

Preferably, the cosolvent is miscible with water.

Preferred cosolvents include ethanol, propanol, acetone, ethylene glycol ethyl ethers, propylene glycol propyl ethers and diacetone alcohol.

Preferred cosolvents include compounds of the formula $$R^3—(OC_nH_{2n})_zOX$$

wherein $R^3$ is selected from a substituted or unsubstituted aliphatic $C_{1-12}$ alkyl group, a substituted or unsubstituted $C_{6-12}$ aryl group, a $—C(O)C_6H_5$ group and a $—C(O)CH_3$ group; wherein n is 2 to 4; wherein z is 1 to 4 and wherein X is selected from a —H, a $—CH_3$ group, a $—C(O)CH_3$ group and a $—C(O)C_6H_5$ group. More preferred cosolvents include compounds of the noted formula wherein $R^3$ is a substituted or unsubstituted aliphatic $C_{1-10}$ alkyl group (more preferably, a substituted or unsubstituted aliphatic $C_{2-10}$ alkyl group; most preferably, a substituted or unsubstituted aliphatic $C_{2-6}$ alkyl group). More preferred cosolvents include compounds of the noted formula wherein n is 2 to 4, wherein z is 1 to 3 and X is a —H.

Preferred cosolvents are selected from the group consisting of tripropylene glycol methyl ether, dipropylene glycol n-butyl ether, tripropylene glycol n-butyl ether, dipropylene glycol n-propyl ether, dipropylene glycol phenyl ether, dipropylene glycol methyl ether acetate, propylene glycol n-propyl ether, diethylene glycol monobutyl ether, diethylene glycol n-butyl ether, diethylene glycol monohexyl ether, diethylene glycol hexyl ether, dipropylene glycol methyl ether, propylene glycol methyl ether, propylene glycol methyl ether acetate, dipropylene glycol methyl ether acetate, propylene glycol diacetate and mixtures thereof.

Preferably, the hard surface cleaning composition of the present invention, further comprises: a pH color indicator. Preferably, the hard surface cleaning composition of the present invention, further comprises a pH color indicator selected from the group consisting of phenolphthalein, methyl red, phenol red, neutral red, thymol blue water soluble, direct yellow 4 (all available from Pylam Products Company, Inc.) and mixtures thereof. More preferably, the hard surface cleaning composition of the present invention, further comprises a pH color indicator selected from the group consisting of phenolphthalein, phenol red, neutral red, direct yellow 4. Most preferably, the hard surface cleaning composition of the present invention, further comprises a pH color indicator is phenol red.

Optionally, the hard surface cleaning composition of the present invention, further comprises an additive. Preferably, the hard surface cleaning composition of the present invention, further comprises an additive selected from the group consisting of a salt, a builder, a fragrance, an enzyme, a corrosion inhibitor, a chelant, an acid, a bleaching agent and mixtures thereof.

The hard surface cleaning composition of the present invention optionally further comprises 0 to 20 wt % (preferably, 0.1 to 10 wt %) of a salt. Preferred salts include alkali metal halides (e.g., sodium chloride, potassium chloride); ammonium salts; nitrates; sulfates; nitrites and mixtures thereof.

The hard surface cleaning composition of the present invention optionally further comprises 0 to 50 wt % (preferably, 0 to 30 wt %; more preferably, 0 to 15 wt %) of a builder. Preferred builders include inorganic builders (e.g., alkali metal polyphosphates such as tripolyphosphate, pyrophosphate); ethylenediaminetetraacetic acid; nitrilotriacetate; alkali metal carbonates; borates; bicarbonates; hydroxides; zeolites and mixtures thereof. Preferred builders include water-soluble organic builders such as citrates, polycarboxylates, monocarboxylates, aminotrismethylenephosphonic acid, hydroxyethanediphosphonic acid, diethylenetriaminepenta(methylenephosphonic acid), ethylenediaminetetraethylene-phosphonic acid, salts thereof, mixtures thereof, and oligomeric or polymeric phosphonates. A combination comprising at least one of the foregoing can be used.

The hard surface cleaning composition of the present invention optionally further comprises 0 to 20 wt % (preferably, 0 to 10 wt %) of a corrosion inhibitor. Preferred corrosion inhibitors include sodium silicate, sodium disilicate, sodium metasilicate and mixtures thereof.

The hard surface cleaning composition of the present invention optionally further comprises 0 to 10 wt % (preferably, 1 to 5 wt %; more preferably, 2 to 4 wt %) of a bleaching agent. Preferred bleaching agents include hydrogen peroxide and chlorine-generating substances (e.g., sodium hypochlorite, chloroisocyanurate).

The hard surface cleaning composition of the present invention optionally further comprises 0 to 10 wt % (preferably, 1 to 5 wt %; more preferably, 2 to 4 wt %) of a chelant. Preferred chelants include sodium gluconate, pentasodium salt of diethylenetriamine pentaacetic acid (available under the name Versenex 80), sodium glucoheptonate, ethylene diamine tetraacetic acid (EDTA), salts of ethylene diamine tetraacetic acid, hydroxyethyl ethylene diamine triacetic acid (HEDTA), salts of hydroxy ethyl ethylene diamine triacetic acid, nitrilotriacetic acid (NTA), salts of nitrilotriacetic acid, diethanolglycine sodium salt (DEG), ethanoldiglycine disodium salt (EDG), tetrasodium N,N-bis (carboxylatomethyl)-L-glutamate (GLDA), methylglycinediacetic acid (MGDA) and mixtures thereof.

The hard surface cleaning composition of the present invention optionally further comprises 0 to 10 wt % (preferably, 1 to 5 wt %; more preferably, 2 to 4 wt %) of an acid. Preferred acids include organic carboxylic acids and salts thereof (e.g., $C_{3-9}$ organic carboxylic acids such as gluconic acid, lactic acid, citric acid, glycolic acid, acetic acid, propionic acid, succinic acid, glutaric acid, adipinic acid, butanedioic acid, isoascorbic acid, ascorbatic acid, tatric acid).

Preferably, the hard surface cleaning composition of the present invention contains <0.5 wt % (preferably, <0.1 wt %; more preferably, <0.01 wt %; most preferably, <0.001 wt %) of sodium carbonate and potassium carbonate in the aggregate.

Preferably, the hard surface cleaning composition of the present invention contains <0.1 wt % (preferably, <0.01 wt %; more preferably, <0.001 wt %; still more preferably, <the detectable limit; most preferably, is free) of monoethanolamine and diethylene glycol monobutyl ether.

Preferably, the hard surface cleaning composition of the present invention contains <0.005 wt % (preferably, <0.001 wt %; more preferably, <0.0001 wt %; still more preferably, <detectable limit; most preferably, is free) of chelating agent.

Preferably, the hard surface cleaning composition of the present invention contains <0.05 wt % (preferably, <0.01 wt %; more preferably, <0.001 wt %; still more preferably, <0.0001 wt %; yet more preferably, <detectable limit; most preferably, is free) of n-butane.

Preferably, the hard surface cleaning composition of the present invention contains <0.05 wt % (preferably, <0.01 wt %; more preferably, <0.001 wt %; still more preferably, <0.0001 wt %; yet more preferably, <detectable limit; most preferably, is free) of polysulfonic acid selected from methanedisulfonic acid, ethanedisulfonic acid, propanedisulfonic acid and 1,3,6-naphthalene trisulfonic acid; when the hard surface cleaning composition also contains a foaming agent selected from the group consisting of an alkyl sulfate, an alkyl sulfonate, an amine oxide and an alkanolamide.

Preferably, the hard surface cleaning composition of the present invention is provided as a single component system (i.e., as a single mixture of materials as opposed to a multi-component system, wherein some of the materials are maintained separately until dispensed for use).

Preferably, the method of cleaning a hard surface of the present invention, comprises: applying (preferably, spraying) a hard surface cleaning composition according to the present invention onto the hard surface forming a foam (preferably, wherein the hard surface cleaning composition thickens upon application (preferably, spraying); wherein the hard surface cleaning composition adheres to vertical surfaces for an extended period of time (preferably, up to three hours on vertical surfaces); letting the foam in place on the hard surface; wherein carbon dioxide evolves from the foam resulting in a change in the pH of the foam over time; wherein the change in the pH triggers a transition of the foam from an initial color upon application (preferably, spraying) onto the hard surface to a transitioned color; wherein the initial color and the transitioned color are different; and wherein the transitioned color provides a visual cue that cleaning is occurring (preferably, the color transitioning provides a further visual cue that the foam is ready from rinsing and removal from the hard surface).

Some embodiments of the present invention will now be described in detail in the following Examples.

Examples 1-2: Hard Surface Cleaning Composition

Prior to carbonation the hard surface cleaning compositions of Examples 1-2 were prepared by mixing together the components in the weight proportions noted in TABLE 1 to form pre-carbonation formulations. The pre-carbonation formulations in both Examples 1-2 had a pH of 10-12 and were observed to be pink in color with a gel-like consistency.

TABLE 1

| Ingredient | Example 1 (wt %) | Example 2 (wt %) |
|---|---|---|
| ionic acrylic based rheology modifier[1] | 5.00 | 7.00 |
| alkyl benzene sulfonic acid/sulfonate[2] | 1.04 | 1.04 |
| nonionic surfactant[3] | 1.00 | 1.00 |
| cosolvent[4] | 1.00 | 1.00 |
| neutralizer-NaOH (32%) | 1.25 | 1.25 |
| water | 90.71 | 88.71 |
| pH color indicator (red phenol) | to color | to color |

[1]Acusol ™ 835 alkali swellable emulsion polymer available from The Dow Chemical Company
[2]Nansa ® SSA/F alkyl benzene sulfonic acids and salts available from Huntsman Corporation
[3]Ecosurf ® EH6 alcohol ethoxylate surfactant available from The Dow Chemical Company
[4]Dowanol ™ DPnB dipropylene glycol n-butyl ether available from The Dow Chemical Company The pre-carbonation formulations in each of Examples 1-2 were then carbonated with carbon dioxide by first centrifuging the pre-carbonation formulations in 250 mL bottles for 12 minutes at 2,000 rpm. Each centrifuged pre-carbonation formulation was then transferred to a separate 500 mL SodaStream carbonating bottle (available from SodaStream USA Inc.). Carbon dioxide was then transferred to each carbonating bottle using a SodaStream carbonation device (available from SodaStream USA Inc.) until the automatic stop of the device was triggered. The contents of the carbonating bottles were then shaken to distribute the dissolved carbon dioxide throughout the contents of the container. This procedure of carbon dioxide addition followed by container shaking was repeated twice. After the final loading of carbon dioxide, the contents of the carbonating bottles were allowed to equilibrate for about fifteen minutes. As noted above, prior to carbonation, the formulations were observed to have a high viscosity gel-like rheology profile. Following the final addition of carbon dioxide and equilibration, the carbonated formulations were both observed to display a uniform low viscosity liquid-like rheology profile throughout the contents of the container. The fully carbonated formulations in both Examples 1-2 had a pH of 5-5.5 and were observed to be yellow in color.

The carbonated formulations were then transferred to tightly sealed 200 mL pump spray bottles. The carbonated formulations were then sprayed onto a vertical surfaces. Both formulations were observed to quickly (in less than 10 seconds) thicken from a low viscosity liquid-like rheology profile to a high viscosity gel-like rheology profile similar to that displayed by the pre-carbonation formulations. The spray applied material was observed to cling to the vertical surfaces for an extended period (>3 hours). Following a color change of the spray applied material back to pink, the material was wiped from the vertical surface leaving a renewed surface with no noticeable residue.

I claim:

1. A hard surface cleaning composition, comprising:

a) 1.5 to 3 wt % of carbon dioxide;

b) 3 to 9 wt % of an ionic acrylic based rheology modifier comprising at least one of an alkali swellable emulsion polymer and a hydrophobically-modified alkali swellable emulsion polymer;

c) 0.5 to 2 wt % of a pH adjuster;

d) 0.5 to 5 wt % of a surfactant selected from the group consisting of a nonionic surfactant, a cationic surfactant, a zwitterionic surfactant, and mixtures thereof;

e) 0.5 to 1.5 wt % of at least one of an alkyl benzene sulfonic acid and an alkyl benzene sulfonic acid salt;

f) 0.5 to 2 wt % of a water-miscible solvent;

g) a pH color indicator; and h) 50 to 97 wt % of water;

wherein the pH of the hard surface cleaning composition is 3.5 to 6.0.

2. The hard surface cleaning composition of claim 1, further comprising:

an additive, selected from the group consisting of a salt, a builder, a fragrance, an enzyme, a corrosion inhibitor, a chelant, an acid, a bleaching agent and mixtures thereof.

3. The hard surface cleaning composition of claim 1, wherein the hard surface cleaning composition contains <0.5 wt % of sodium carbonate and potassium carbonate in aggregate.

4. The hard surface cleaning composition of claim 1, wherein the hard surface cleaning composition does not contain both monoethanolamine and diethylene glycol monobutyl ether.

5. The hard surface cleaning composition of claim 1, wherein the hard surface cleaning composition is provided in a single component system.

6. The hard surface cleaning composition of claim 1, wherein the hard surface cleaning composition contains <0.005 wt % of a chelating agent.

7. The hard surface cleaning composition of claim 1, wherein the hard surface cleaning composition contains <0.05 wt % of n-butane.

8. The hard surface cleaning composition of claim 1, wherein the hard surface cleaning composition contains <0.005 wt % of a polysulfonic acid selected from methanedisulfonic acid, ethanedisulfonic acid, propanedisulfonic acid and 1,3,6-naphthalene trisulfonic acid; in combination with a foaming agent selected from alkyl sulfates, alkyl sulfonates, amine oxides and alkanolamides.

9. The hard surface cleaning composition of claim 1, wherein the ionic acrylic based rheology modifier comprises a compound of Formula (I):

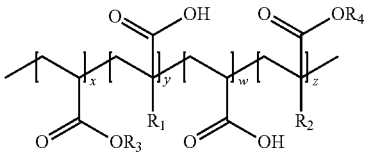

(I)

wherein $R_1$ and $R_2$ are each independently selected from a H and a $C_1$-$C_6$ alkyl group;

wherein $R_3$ and $R_4$ are each independently selected from a H and a $C_1$-$C_{24}$ alkyl or alkoxylated alkyl group.

10. A method of cleaning a hard surface, comprising:

spraying a hard surface cleaning composition according to claim 1 onto the hard surface forming a foam;

letting the foam remain on the hard surface;

wherein the carbon dioxide evolves from the foam resulting in a change in the pH of the foam over time;

wherein the change in the pH triggers a transition of the foam from an initial color upon application to the hard surface to a transitioned color;

wherein the initial color and the transitioned color are different; and wherein the transitioned color provides a visual cue that cleaning is occurring.

11. The hard surface cleaning composition of claim 1, wherein the color indicator is selected from the group consisting of phenolphthalein, methyl red, phenol red, neutral red, thymol blue water soluble, direct yellow 4 and mixtures thereof.

12. The method of cleaning a hard surface of claim 10, wherein the color indicator is selected from the group consisting of phenolphthalein, methyl red, phenol red, neutral red, thymol blue water soluble, direct yellow 4 and mixtures thereof.

* * * * *